United States Patent [19]

Marie et al.

[11] Patent Number: 4,483,638

[45] Date of Patent: Nov. 20, 1984

[54] DEVICE FOR FIXING A PIERCING OR EXPANDING PLUG TO A PIERCING OR EXPANDING BAR

[75] Inventors: Roland Marie, Valenciennes; Michel Locoge, Quarouble; Patrick Lambay, Valenciennes, all of France

[73] Assignee: Vallourec, Paris, France

[21] Appl. No.: 268,175

[22] Filed: May 29, 1981

[51] Int. Cl.[3] ..... F16D 1/00; B25G 3/00

[52] U.S. Cl. ..... 403/20; 403/328; 403/324

[58] Field of Search ..... 403/324, 325, 326, 327, 403/328, 321, 361, 362, 405, 20

[56] References Cited

U.S. PATENT DOCUMENTS

| | | | |
|---|---|---|---|
| 1,903,772 | 4/1933 | Bowman | 299/86 X |
| 2,220,610 | 11/1940 | Miller | 403/328 |
| 2,349,341 | 5/1944 | Disse | 72/481 X |
| 2,355,899 | 8/1944 | Beede | 403/362 |
| 3,058,211 | 10/1962 | Axtell | 403/408 |
| 3,434,743 | 3/1969 | Boeker | 411/517 X |
| 3,452,584 | 7/1969 | Jones | 403/326 |
| 3,752,515 | 8/1973 | Oaks et al. | 411/517 X |
| 3,762,731 | 10/1973 | Matsumoto | 279/83 X |
| 4,088,008 | 5/1978 | Watling et al. | 403/328 |
| 4,327,947 | 5/1982 | Bower | 411/517 X |

*Primary Examiner*—Andrew V. Kundrat

[57] ABSTRACT

The invention relate to fixing a plug in the end of a bar, the assembly being used for production of cylindrical hollow blanks which will be later rolled.

The device comprises a plug including at its rear end a shank which can be introduced into an axial socket provided at one end of the bar. A locking means can be introduced transversely through a hole in the wall of the bar and engage its end within a groove realized around the shank. A retaining means holds the locking means in position.

The device is used for rapid mounting and dismantling the plug and bar assembly.

6 Claims, 4 Drawing Figures

DEVICE FOR FIXING A PIERCING OR EXPANDING PLUG TO A PIERCING OR EXPANDING BAR

The invention is concerned with fixing the shank of a piercing or expanding plug which is used in a piercing or expanding rolling mill to convert a cylindrical blank or a billet into a cylindrical hollow blank, in an end housing of a piercing or expanding bar.

The invention is also concerning most generally any device used for fixing a plug to its relevant bar for any operation or step relative to tube manufacturing by a rolling or expanding operation.

Many possible ways of fixing the plug which is employed in the piercing or expanding operation carried out on a piercing or expanding rolling mill, to its relevant bar which transmits the rolling forces, to which the plug is subjected, to an abutment disposed on the exit axis of the piercing or expanding mill, are known.

The problems to be overcome in regard to a piercing or expanding plug and the fixing thereof to a relevant bar depend on the rolling method.

A distinction may be made between the following different methods:

(1) When the wear-resistance and the resistance to increased temperature of a piercing or expanding plug, which may or may not comprise internal cooling means, is such that the piercing or expanding plug does not need to be changed for a large number of successive rolling operations, fixing the piercing or expanding plug on the relevant bar does not give rise to any particular difficulty, and is then effected by conventional methods such as screw means or interengaging tapers.

(2) When resistance of the piercing or expanding plug is such that it is essential for it to be renewed after each piercing or expanding operation, for inspecting it and cooling it outside of the axis of the pass movement of the piercing or expanding mill, depending on the type of installation, it is possible:

either to change both the piercing or expanding plug and the piercing or expanding bar between each piercing or expanding operation (a 'circulating-bar' piercing or expanding arrangement). In a simple arrangement, the operator removes a complete assembly comprising the piercing or expanding plug and the relevant bar, and replaces it by a fresh assembly, the piercing or expanding plug being changed at another location, for example in the maintenance works; the fixing of the piercing or expanding plug on the bar may again be effected by conventional mounting methods such as screw means, or interengaging tapers;

or change the piercing or expanding plug alone, which involves a fixing which is fairly easy to dismantle in order that the piercing or expanding plug can be collected by a suitable device upon removal of the blank and the bar-piercing or expanding plug assembly from the piercing mill at the end of the piercing or expanding operation, while however being easy to reassemble so that it can be refitted to and retained by the bar when the bar returns to a position on the axis of the piercing or expanding mill, in the waiting position for the following blank; in that case, the fixing between the piercing or expanding plug and the bar is more difficult.

One solution has been proposed, as described in German patent application DOS No. 23 47 385, FIGS. 1 to 7, which comprises disposing a locking device which is controlled by an axial rod, within the piercing bar which is tubular. The locking device comprises balls which are engaged in holes formed in the tubular wall of an additional part fixed in front of the bar, at its working end.

That part of the bar is engaged in a housing provided in the rearward part of the piercing or expanding plug, and an axial control rod, which extends over the entire length of the bar and which is controlled from the other end, is provided with a head member which moves the balls radially apart and applies them against an annular groove formed in the housing. Such an arrangement, which comprises a relatively complex control mechanism which is entirely disposed within the piercing bar and which extends over the entire length thereof, considerably increases the cost thereof. Moreover, if it can be produced in the case of bars of fairly short lengths and fairly large diameters which are used solely for the piercing or expanding operation, this is no longer the case when the bar is to be used, not only as a support for the plug for piercing or expanding the blank, but also as a mandrel for rolling the blank, as described in French patent No. 2.198.797.

In that process, once the piercing operation has been performed, the assembly formed by the piercing bar, at the end of which the piercing plug remains fixed, and the hollow blank which is disposed around the bar, is moved away from the axis of the piercing mill and is conveyed towards the entry table of a continuous rolling mill, while a fresh bar provided with its piercing plug is brought into a waiting position on the axis of the piercing mill, for piercing the following blank.

After having passed through the continuous rolling mill, the same assembly in which the blank, now having been made into a long tube still disposed around the bar, is conveyed to a mandrel-removing apparatus; the bar and the pear-shaped piercing plug which are still fixed together are then extracted from the tube and conveyed to installations for cooling, lubrication a.s.o., before being brought again on the axis of the piercing mill.

It will be appreciated that, in order to avoid waiting periods at each working station, there is always a set of bars, each provided with a piercing plug, circulating between the piercing mill, the continuous rolling mill, the mandrel-removing apparatus, a.s.o. Such a set of bars comprises for example from 12 to 15 units.

When using such a method, very high rates are attained, and the time interval between rolling two successive blanks may generally be of the order of about 12 seconds or a little more.

In the operating sequence briefly described hereinbefore, it may be an attractive proposition for a location to be provided on the path of movement of the bar, at which an operator could monitor, as it passes, the surface condition of the piercing plug, and judge whether the piercing plug is or is not suitable for being returned to the piercing mill, for a fresh operation without the danger of producing defects on the inside surface of the blank. If the piercing plug is judged as unsuitable for continuing the piercing operations, the problem of replacing it then arises. Then, as described above, it would be possible to envisage removing the complete assembly of a piercing plug and a piercing bar, to replace it by a fresh assembly. However, such a method would suffer from many disadvantages in regard to industrial operation of a process which uses that assembly as a rolling mandrel.

Indeed, in a conventional process which does not use the bars carrying the piercing plugs as a rolling mandrel in the continuous rolling mill, the length of the bars is calculated according to the length of the exit bench or table of the piercing mill; for practical reasons, the bars are generally longer than the longest pierced blank, by about 2 meters. For example, for a maximum length of pierced blank of 10 meters, which is already a considerable length and which corresponds to tubes of 30 meters after passing through the continuous rolling mill, the length of the bars carrying the piercing plug will be about 12 meters.

In addition, the diameter thereof is not strictly linked to the internal diameter of the pierced blank, the amount of clearance between the two being of no importance for the process, from the moment that the bar is sufficiently strong to withstand the axial compression forces.

A given bar diameter may therefore be suitable for producing pierced blanks which have an entire range of different inside diameters. Finally, the bars are in most cases tubular and made out of traditional construction or structural steel.

In contrast, in the process described in French patent No. 2.198.797, the length of the bar depends on the maximum length of the rolled tubes; for the above-mentioned lengths in respect of the pierced blank and the rolled tube, the bar reaches a length of 17 meters.

In addition, the number of bar diameters available must correspond to the number of different inside diameter tubes to be capable of being rolled.

Finally, the bars, which must withstand crushing forces as they pass through the continuous rolling mill, must have a very high level of mechanical strength and for that reason are solid in most cases.

In principle, it is possible to use tubular bars, but for reasons of mechanical strength, the inside diameter thereof must be very small.

It will be seen therefore that, in practice, performing the process which has just been described requires the use of bars which are heavier (up to three times heavier) and therefore more expensive, than the conventional process.

The number of bars which must be available for a works capable of industrially producing a wide variety of rolled tubes is much larger and the corresponding capital investment becomes highly expensive.

In order very substantially to reduce the level of capital investment, for each tube size to be produced, attempts have been made to limit the number of bars used to the strict minimum required for ensuring circulation without giving rise to waiting periods at the piercing mill or the continuous rolling mill.

For that purpose, it was necessary to be able to avoid having to provide a certain number of additional piercing bars provided with piercing plugs for replacing the bar-piercing plug assemblies whenever a piercing plug is damaged. As the piercing plug is a conically pointed member of special steel, about thirty centimeters in length, which can be manually handled, the attempt was made to find a way of producing a novel device for rapid fitting and dismantling, which permits a piercing plug to be fixed to a piercing bar.

In order to achieve the desired aim, such a device must permit replacement of a damaged piercing plug by another such plug, within a time period of the order of about 12 seconds approximately, without using a particular tool. It must also be such that it can be applied to bars of substantial length, which are solid in most cases, and it consequently must not require actuating means which are disposed in an axial housing from one end of the bar to the other.

Such a fixing device must also have the following characteristics:

- resistance to compression and rotational bending forces during the piercing operation,
- resistance to heat radiation upon contact with a blank at a temperature of 1250° C.,
- resistance to impacts to which the assembly is subjected during its movement through the handling equipment (conveyors, ejectors, distributors, cooling tanks, a.s.o.) which form the major part of the re-circulation circuit,
- resistance to vibration, produced in the bar during the rolling operation and in particular at the moment at which the end of the assembly, which includes the piercing plug-piercing bar connection, progresses at high speed between the rolls of the housings of the continuous rolling mill,
- capability for rapid change of the piercing plug when the latter is found, after a checking operation, to have been damaged,
- capability for replacement of any parts of the fixing device itself which may possibly be failing.

It must be possible for all these operations to be carried out within the period of time of the order of bout 12 seconds, as referred to above, so as not to reduce the rate of production of the mill.

The novel device object of the invention has all the desired characteristics, and makes it possible to provide a particularly simple and efficient solution to the problem which is thus set.

The device along the invention capable of rapid mounting and dismantling, for fixing a piercing or expanding plug to the end of a piercing or expanding bar, comprises a piercing plug provided with a shank, the largest diameter of which is less than that of the piercing or expanding bar, an axially symmetrical housing provided at one of the ends of the bar and into which the shank of the plug can be introduced, an annular groove at the periphery of the shank of the plug a hole which passes through the wall of the bar and opens into the axial housing facing the groove when the shank is inserted into the housing, a locking means which may be introduced into the hole so that the front end thereof goes beyond the bottom of the hole and engages into the groove, and a retaining means which is introduced into the hole behind the locking means so as to hold the locking means in position.

Embodiments of the device according to the invention will now be described by way of non-limiting examples. In the accompanying drawings which provide for better understanding of the embodiments:

FIG. 1 shows a rotationally symmetrical piercing plug (1) which comprises a cylindrical shank (2) which is introduced into a cylindrical housing or recess (3) which opens at the end of a bar (4).

Figure 1:
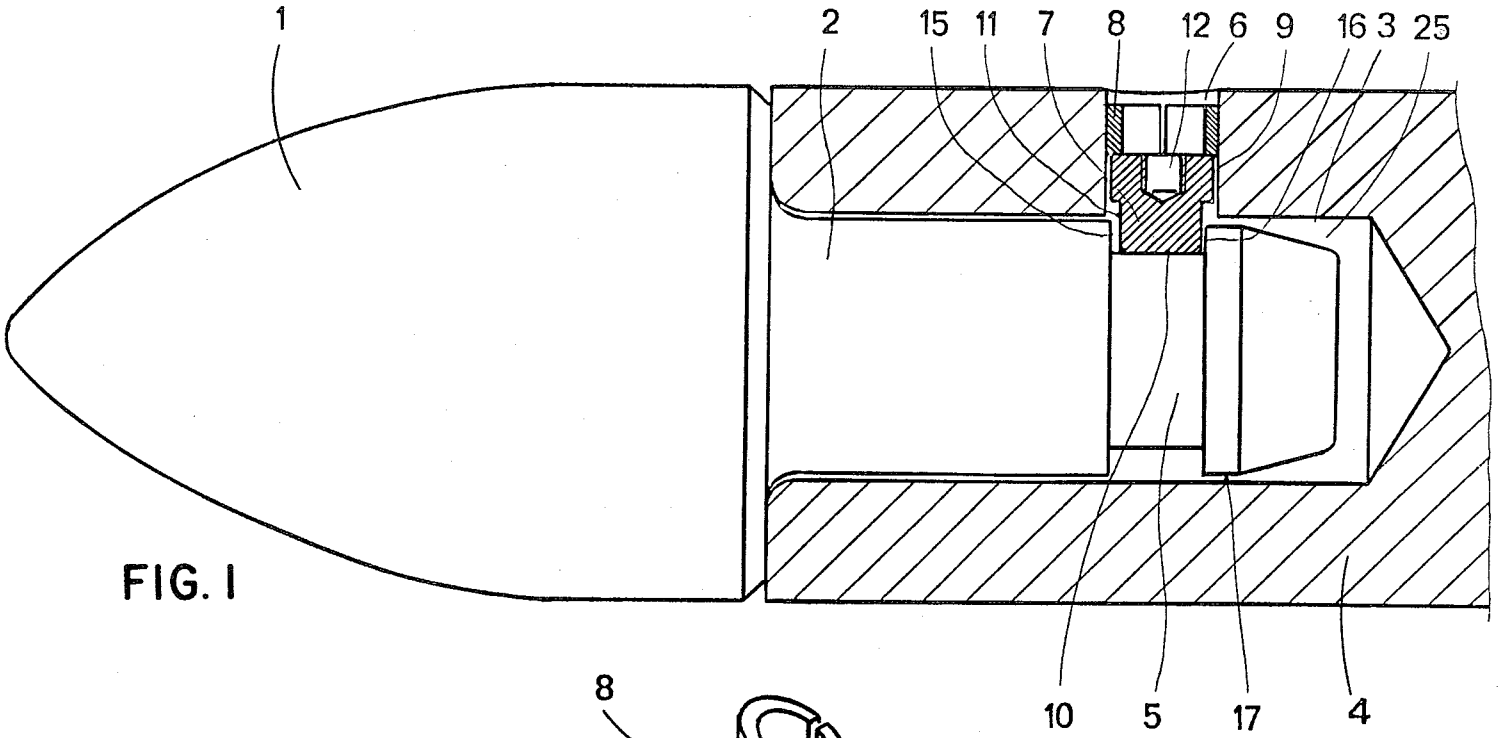
FIG. 1 is a view in axial section of the shank of a piercing plug in a housing in a piercing bar, the piercing plug being retained in the housing by a device according to the invention.

The shank (1) has a circular groove (5) and the wall of the bar is apertured with a smooth hole (6) which opens facing the location at which the groove is to be found when the shank of the piercing plug is fully inserted into the housing. A locking means is introduced into the hole (6), the locking means comprising a steel bolt member (7) having a cylindrical head (9) whose outside diameter is less than the inside diameter of the hole (6) so that there is clearance between the bolt member and the hole, and a retaining means which comprises a split annular ring (8), made of steel with a high elastic limit, and the outside diameter of which, in the absence of mechanical stresses, is larger than the inside diameter of the hole (6).

The bolt member (7) is introduced into the hole (6) in such a way that the front end thereof bears against the bottom of the groove (5). The split ring (8) is forcibly driven into the hole (6).

The dimensional and mechanical characteristics of the ring (8) are so calculated that the elastic deformation, to which it is subjected so as to be able to engage into the hole (6), results in radial stresses on the wall of the hole such that the frictional resistance opposes movement of the ring under the effect of centrifugal forces or impact forces when the assembly is in operation, thus preventing any movement of the bolt member (7).

Figure 2:
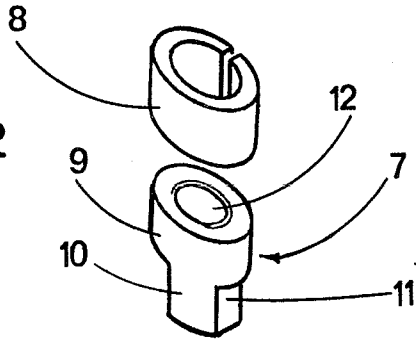
FIG. 2 is a perspective view of the locking means and the retaining means shown in FIG. 1.

As can be seen from FIGS. 1 and 2, the bolt member (7) has a cylindrical head (9) and a front portion (10) which engages into the groove (5). The diameter of the head (9) is less than that of the hole (6), as stated above, but larger than the width of the groove (5).

The front portion (10) has two flats such as at (11), which are parallel to each other and to the axis of the bolt member and the distance between which is less than the width of the groove (5). Thus, the end of the bolt member easily engages into the groove provided that it is suitably oriented, but it cannot turn about itself as long as it remains engaged.

The length of the front portion (10), as measured parallel to the axis of the bolt member, is at least equal to the depth of the groove (5) and greater than that depth, in the embodiment shown in FIG. 1, in order readily to engage into the groove to the bottom thereof. The head (9) is within the hole (6) so as to prevent the shank from coming out of its housing.

Figure 3:
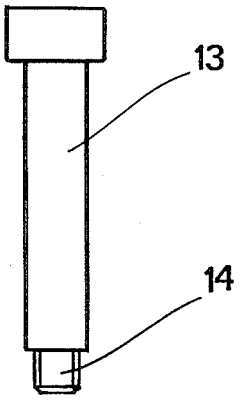
FIG. 3 is an elevational view of a tool for extracting the locking means.

The head comprises a gripping means formed by an axial screw-threaded bore (12). It is thus possible to take hold of the head (9), using an extraction means such as the rod (13) presented FIG. 3, which is engaged into the hole (6) through the ring (8), and which, at its end, has a male screwthread (14) which is engaged into the screw-threaded bore (12).

The bolt member (7) and the ring (8) are pulled out without difficulty, by applying a pulling force of only a few tens of newtons to the rod (13).

The dimensional characteristics of the various parts of this device are so calculated that the clearance between the front end (10) of the bolt member (7) and the side walls of the groove (5) is such that no force can be transmitted to the bolt member under the effect of axial rolling reaction forces on the piercing plug, even after substantial wear of the piercing plug-bar contact surface. For that purpose, in particular the clearance indicated at (15) is larger than the clearance indicated at (16).

Moreover, the part of the shank of the plug which is beyond the groove has a clearance (17), relative to the bore of the bar, which is larger than the clearance of the part which is on the other side, so that it does not behave as an embedded part with regard to the bore and cannot bring forces which could result in rupture at the location of the groove.

Tests have shown that the very simple device according to the invention fulfills the many requirements referred to hereinbefore, and that a locking means comprising a simple cylindrical bolt member of steel, of low weight, for example of the order of 25 g, and of small external volume, of the order of 3 $cm^3$, in association with a retaining means comprising a simple expansible pin, provides for correct fixing, even for speeds of rotation of the order of 1000 rpm (which corresponds to a centrifugal force of the order of several tens of G) and for shearing forces of the order of 140 $kg/mm^2$.

There are thus several ways to prevent the turning of the bolt member (7) around its axis. In FIGS. 1 and 2 it is seen that this result is obtained in engaging the flattened lower part of the bolt within a groove whose diameter is larger than the width of the groove.

The same result could be obtained by using a bolt member of polygonal cross section engaged within a hole realized in the wall of the bar presenting a non circular cross section such that the bolt member cannot turn around its axis but only be introduced or withdrawn without turning.

Figure 4:
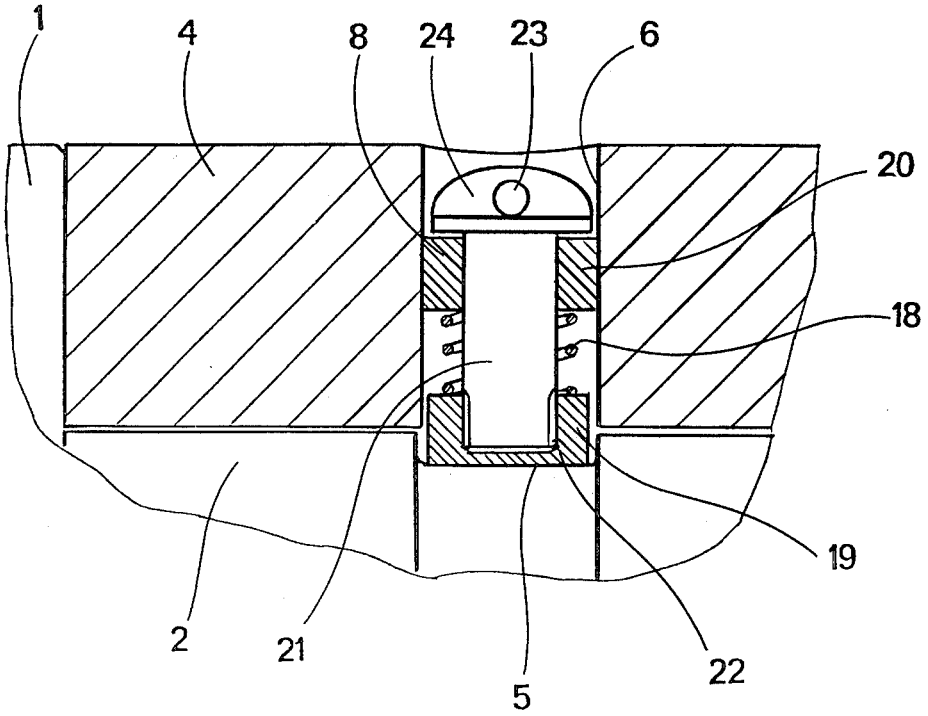
FIG. 4 is a sectional view of an alternative embodiment of the device according to the invention.

FIG. 4 shows still another embodiment of the device according to the invention.

A compressible thrust means comprising a coil spring (18) is interposed between a bolt member (19) and a retaining ring (20). A screw (21), which passes freely through the ring and the spring, is screwed right home into the screw-threaded bore (22) of the bolt member (19).

The head (24) of the screw is housed in the hole (6) above the ring; it has an aperture (23) for forcible extraction of the bolt member+spring+ring assembly by means of a hook tool (not shown). This embodiment has the advantage that it is possible for the piercing plug to be withdrawn, without the necessity to extract the assembly comprising the locking means and the retaining means; indeed, by pulling with the hook tool, it is sufficient for the bolt member (19) to be raised in the direction of the retaining ring (20) by a sufficient amount for its end to come out of the groove (5), thereby to free the piercing plug (1).

On the other hand, when the shank (2) of the piercing plug is to be set in position, the shank (2) is introduced into the housing in which the bolt member (19) is in a projecting position by virtue of the force of the spring; the tapered end (25) (FIG. 1) of the shank progressively moves the front end of the bolt member (19) (FIG. 2) away into the hole (6), until it is retracted.

When the shank has been pushed in, to the point that the groove (5) is disposed facing the hole (6), the spring expands and pushes the bolt member into the groove.

Other compressible thrust means may be used for the same purpose.

It will be appreciated that the invention is not limited to a particular use of the piercing or expanding plug and the preferred example of use which has been described hereinbefore is not limiting.

In particular, use of the device according to the invention is not only limited to the situation where the bar is used not only for piercing or expanding the blank but also as a mandrel for a continuous rolling operation. The very high degree of simplicity of the device according to the invention, and the economy of production which it achieves, also justify use thereof in all situations where it is proposed that a connection which can be easily released and re-assembled is to be made between a piercing or expanding plug and a relevant bar.

We claim:

1. A rapid dismantling and reassembly device for securing a plug to the end of a bar wherein one end of the bar comprises a socket and has a smooth hole communicating between an outside surface of the bar and the socket and wherein the plug is affixed to a shank which rests in said socket, said shank having on its periphery an annular groove, the device comprising a locking means which rests in said hole and has a front end which extends into said annular groove, the front end having a cross section having a larger dimension which is greater than the width of the groove and a smaller dimension which is narrower than the width of the groove, and a retaining means comprising a ring having elastic properties, said retaining means being disposed within said hole between said locking means and the outside surface of said bar and said locking means including a gripping means for removing said locking means and said retaining means from said hole.

2. A device according to claim 1 wherein the locking means comprises a substantially cylindrical head having a diameter that is larger than the width of the groove.

3. A device according to claim 1 wherein the gripping means maybe reversably attached to an extracting means by means of matching threads on said gripping means and said extracting means.

4. A device according to claim 1 wherein the retaining means is in contact within the hole with the locking means.

5. A rapid dismantling and reassembly device for securing a plug to the end of a bar wherein one end of the bar comprises a socket and has a smooth hole communicating between an outside surface of the bar and the socket and wherein the plug is affixed to a shank which rests in said socket, said shank having on its periphery an annular groove, the device comprising a locking means which rests in said hole, a retaining means disposed in said hole between said locking means and the outside surface of said bar, a compressible thrust means between said retaining means and said locking means, and a member which is attached to said locking means and communicates with a portion of said hole which is between said retaining means and the outside surface of said bar, wherein the locking means has a threaded hole and wherein said member is a bolt threadingly engaged on one end with the hole in said locking means, said bolt passing through the retaining means and being provided on the other end with a locking engagement means.

6. A device according to claim 5 wherein the compressible thrust means is a spring.

* * * * *